US006539915B1

(12) United States Patent
Wild et al.

(10) Patent No.: US 6,539,915 B1
(45) Date of Patent: Apr. 1, 2003

(54) METHOD AND DEVICE FOR OPERATING AN INTERNAL COMBUSTION ENGINE

(75) Inventors: Ernst Wild, Oberriexingen (DE); Roland Herynek, Oetisheim (DE); Miriam Steger, Vaihingen (DE); Gudrun Menrad, Stuttgart (DE); Lutz Reuschenbach, Stuttgart (DE); Michael Oder, Illingen (DE); Werner Hess, Stuttgart (DE); Hans Hillner, Karlsruhe (DE); Georg Mallebrein, Korntal-Muenchingen (DE); Christian Koehler, Erligheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/673,213

(22) PCT Filed: Feb. 12, 2000

(86) PCT No.: PCT/DE00/00416

§ 371 (c)(1),
(2), (4) Date: Dec. 7, 2000

(87) PCT Pub. No.: WO00/49281

PCT Pub. Date: Aug. 24, 2000

(30) Foreign Application Priority Data

Feb. 16, 1999 (DE) ..... 199 06 378

(51) Int. Cl.[7] ..... F02B 17/00

(52) U.S. Cl. ..... 123/295; 123/305; 701/102; 701/105; 701/114

(58) Field of Search ..... 123/295, 305, 123/408; 701/102, 104, 105, 114

(56) References Cited

U.S. PATENT DOCUMENTS 6,202,624 B1 * 3/2001 Stuerz et al. ..... 123/295

FOREIGN PATENT DOCUMENTS

| | | | | |
|---|---|---|---|---|
| DE | 196 31 986 | | 2/1998 | |
| DE | 197 44 230 | | 4/1999 | |
| DE | 198 50 586 | | 5/2000 | |
| WO | WO 99/00591 | * | 6/1997 | ..... F02D/21/08 |

* cited by examiner

*Primary Examiner*—Tony M. Argenbright
*Assistant Examiner*—Johnny H. Hoang
(74) *Attorney, Agent, or Firm*—Walter Ottesen

(57) ABSTRACT

Method and arrangement for operating an internal combustion engine (10) which can be operated in several modes of operation, especially an internal combustion engine (10) having direct injection (DE) or intake manifold injection (SRE) and with a control apparatus (11). The control apparatus (11) or its software has a plurality of functions (12) and a scheduler (13) for activating the functions (12). Operating modes are assigned to the functions (12) and the functions (12) are activated by the scheduler (13) in dependence upon the assigned modes of operation.

14 Claims, 5 Drawing Sheets

METHOD AND DEVICE FOR OPERATING AN INTERNAL COMBUSTION ENGINE

STATE OF THE ART

FIELD OF THE INVENTION

The invention relates to a method for operating an internal combustion engine, especially of an internal combustion engine having direct injection (DE) or intake manifold injection (SRE) and having a control apparatus. The control apparatus, or more specifically its software, has a plurality of functions and a scheduler to activate the functions.

BACKGROUND OF THE INVENTION

A control apparatus for a system and a method for operating a control apparatus is known from unpublished patent application DE 197 44 230. Here, the control apparatus includes function modules, a scheduler for activating the function modules, and a priority administrator. The priority administrator assigns to the function modules changeable priorities which are then considered by the scheduler for the activation of the function modules.

SUMMARY OF THE INVENTION

The present invention has the object of improving a method of the above kind in such a manner that functions are optimally activated in dependence upon operating conditions of the engine.

The especially significant advantage of the present invention lies in the fact that functions are only then marked or made ready for activation when they are permitted to run in one of the instantaneously possible modes of operation of the engine.

Further advantages of the invention will become evident in combination with the dependent claims from the description of the embodiments which follows.

Especially significant is that it is ensured that marked functions are only then activated when a permissible mode of operation therefor is set and that the scheduler can intervene actively in the selection of the mode of operation.

BRIEF DESCRIPTION OF THE DRAWINGS

Embodiments of the invention are shown in the drawing and are explained in greater detail in the description which follows.

DESCRIPTION OF THE PREFERRED EMBODIMENTS OF THE INVENTION

Even though the present invention is explained in the context of an internal combustion engine having direct injection, this invention can be used for the control of any desired electromechanical system which is equipped with a control arrangement.

Figure 1:
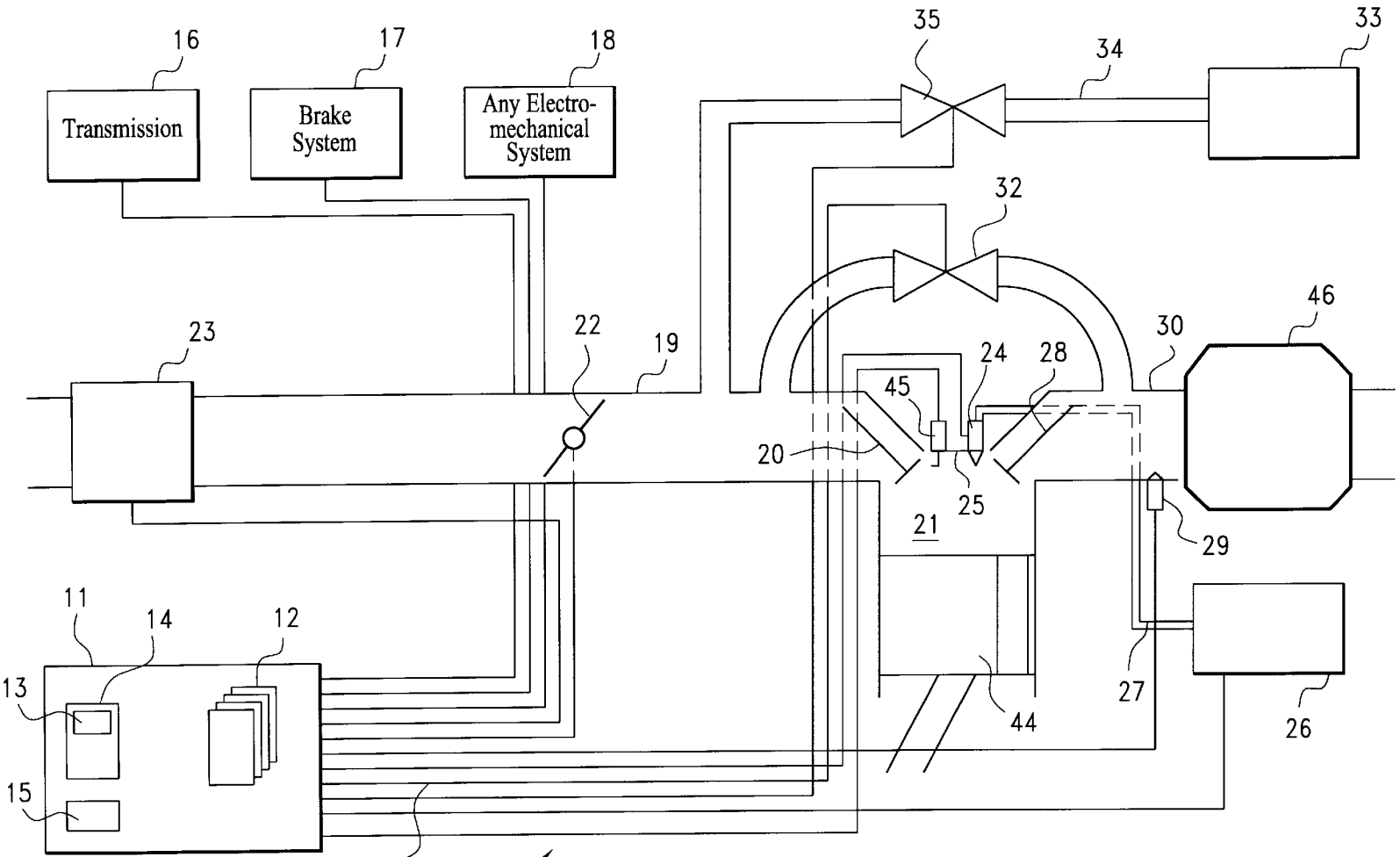
FIG. 1 shows schematically an illustration of an internal combustion engine having a control apparatus.

As shown in FIG. 1, for an engine having direct injection 10, fresh air is supplied via an intake manifold 19 via an inlet valve 20 of a combustion chamber 21. The quantity of the fresh air, which is supplied into the combustion chamber 21, is controlled via a throttle flap 22. An air-quantity sensor 23 detects the fresh air flowing into the engine. An injection valve 24 and a spark plug 45 are mounted in the cylinder head 25. The fuel is brought to a working pressure by means of a high-pressure pump 26 and is injected into the combustion chamber 21 via a fuel line 27 and injection valves 24. The injected fuel is ignited with the aid of the spark plug 45. A piston 44 is driven by the expansion of the ignited fuel. Furthermore, the combustion chamber 21 includes an outlet valve 28 to discharge the exhaust gases arising during a combustion. The oxygen component in the exhaust gas can be measured by means of a broadband lambda probe (LSU) 29 in the exhaust-gas pipe 30 whereby the air/fuel ratio in the mixture can be determined. A catalytic converter 46 is mounted in the exhaust-gas pipe 30. The catalytic converter 46 has the task of converting toxic exhaust-gas components such as CO, HC and NO into CO2, H2O and N2. An EGR line 31 connects the exhaust-gas pipe 30 to the intake manifold 19 whereby exhaust gases from the exhaust-gas pipe 30 are conducted in to the intake manifold 19 because of the higher pressure in the exhaust-gas pipe 30. With the aid of the EGR valve 32, the exhaust-gas flow can be controlled in the EGR line 31. A tank-venting line 34 leads from a fuel tank or active charcoal filter 33 to the intake manifold 19 whereby additional fuel can reach the intake manifold 19 and therefore also reaches the combustion chamber 21. The fuel flow in the tank-venting line 34 can be controlled by means of a tank-venting valve 35. The control of the entire engine 10 takes place by means of a control apparatus 11. Furthermore, the control apparatus 11 can control a transmission 16, a braking system 17 and any desired other electromechanical systems 18. The various sensors and actuators are connected to the control apparatus 11 via signal and control lines 36.

The control apparatus 11 includes an operating mode coordinator 14 and an operating mode switchover 15 and a plurality of functions 12. The operating mode coordinator 14 includes a scheduler 13. The scheduler 13 administers, in general, diagnostic and engine control functions 12 which have couplings with respect to each other and therefore cannot run simultaneously. An example for this are the functions "tank venting" and "diagnosis of the broadband lambda probe 29". The function "tank venting" functions to reduce the vapor emissions of the fuel and effects that fuel from the fuel tank or active charcoal filter 33 reaches the intake manifold 19 and thereby the combustion chamber 21. The function "diagnosis of the broadband lambda probe 29" checks whether the broadband lambda probe 29 functions properly. However, for this purpose, defined conditions in the fuel supply and the air supply of the engine are necessary. If the function "tank venting" is activated during the diagnosis of the broadband lambda probe 29, then additional fuel flows into the combustion chamber whereby the diagnostic conditions (changed fuel supply) change and the result of the diagnosis becomes incorrect.

The operating mode coordinator 14 selects a desired mode of operation in dependence upon the operating mode requests of the functions 12 of the engine 10. The desired operating mode enters into the operating mode switchover 15. After a switchover of the modes of operation via the operating mode switchover 15, the desired operating mode is adjusted as the actual operating mode of the engine.

The engine 10 can be operated in various operating modes which differ essentially by the injection time point and the ignition time point. A switchover between the operating modes of the engine 10 can be made with the aid of the control apparatus 11. The switchover of the operating modes is triggered by the functions "operating mode coordinator 14" and "operating mode switchover 15" in the control apparatus 11 and is executed. Operating modes of the engine can be: the homogeneous operation "hom", the homogeneous lean operation "hmm", the stratified operation "sch", the homogeneous stratified operation "hos" and the stratified catalytic converter heating "skh".

In the homogeneous operation "hom", the fuel is injected by the injection valve 24 into the combustion chamber 21 during an induction phase brought on by the piston movement. At the same time, air is inducted via the throttle flap 22. The inducted air swirls the fuel which distributes thereby in the combustion chamber almost uniformly or homogeneously. The air/fuel mixture is subsequently compressed and then ignited by the spark plug 45. The ignited air/fuel mixture expands and drives the piston 44. The developing torque is dependent in homogeneous operation essentially on the position of the throttle flap 22. In order to obtain a high torque and a low development of toxic substances during combustion, the air/fuel mixture is adjusted as close as possible to lambda=1 or lambda<1.

In the homogeneous lean operation "hmm", the fuel is injected into the combustion chamber 21 as in homogeneous operation during the induction phase. As a difference to the homogeneous operation, an air/fuel mixture is adjusted with lambda>1.

In the stratified operation "sch", the throttle flap 22 is opened wide. The fuel is injected during the compression phase into the immediate vicinity of the spark plug 45. Then, the fuel is ignited by the spark plug 45 and the piston 44 is driven by the subsequent expansion of the ignited fuel. In stratified operation, the developing torque is dependent essentially on the injected fuel mass.

A double injection takes place in homogeneous stratified operation "hos". Here, fuel is injected into the combustion chamber 21 during the induction phase and during the compression phase. The homogeneous stratified operation combines the characteristics of the homogeneous operation and the stratified operation. With the aid of the homogeneous-stratified operation, an especially soft transition from homogeneous operation into stratified operation and vice versa can, for example, be achieved.

A double injection also takes place in the operating mode "stratified catalytic converter heating" (skh). The fuel is injected into the combustion chamber during the compression phase and during the working phase or during the compression phase and during the exhaust phase. In this way, a rapid heating of the catalytic converter 46 is effected and essentially no additional torque is generated. This operating mode is, for example, of significance for cold starting the engine 10.

Figure 2:
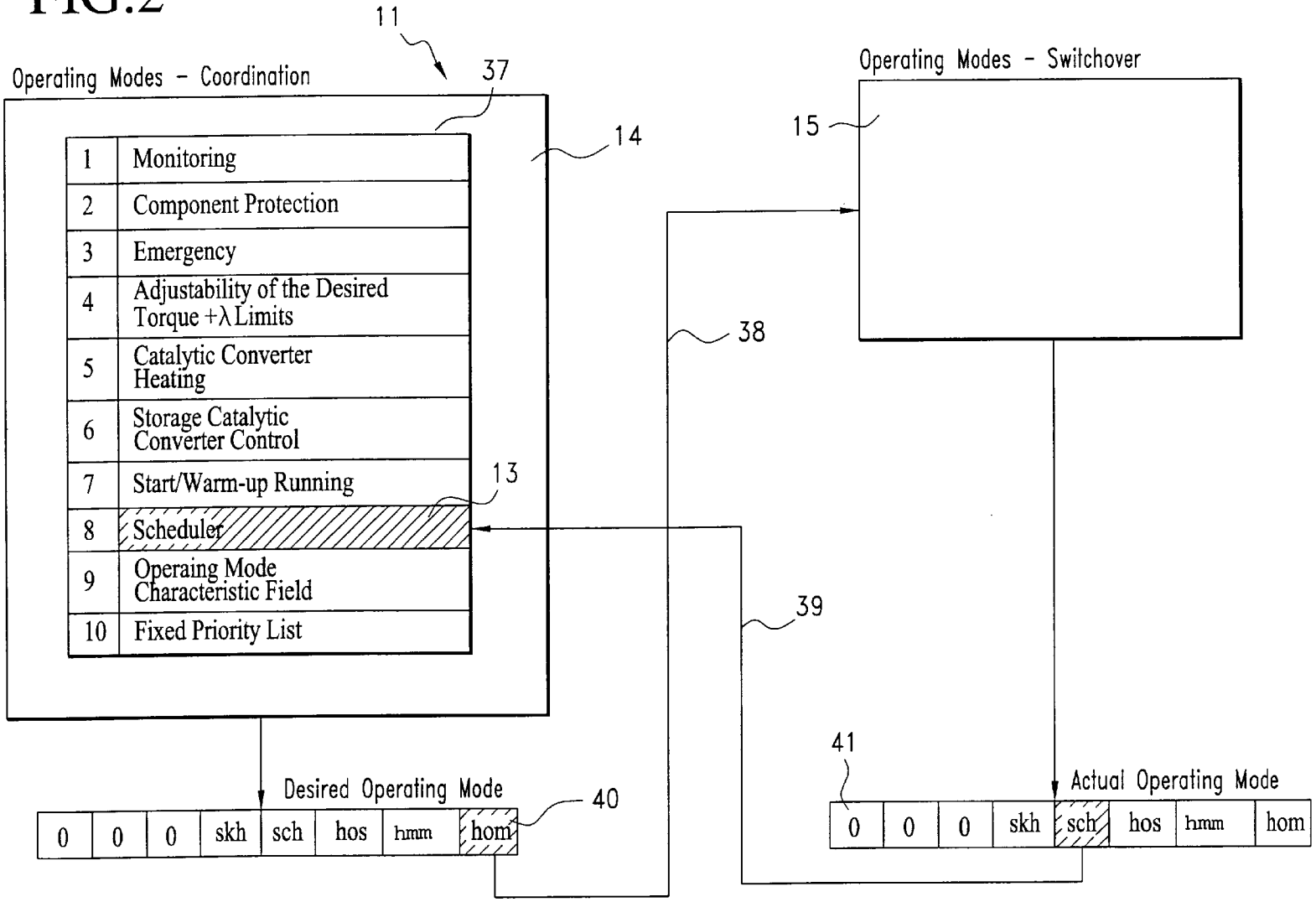
FIG. 2 shows schematically the control apparatus with the functions "operating mode coordinator" and "operating mode switchover"

FIG. 2 shows a control apparatus 11 having the functions "operating mode coordinator" 14 and "operating mode switchover" 15. The function "operating mode coordinator" 14 has a demand list 37 of functions in the sequence of their priority.

The above relates to a function monitoring of the engine 10. In this way, it is ensured that the engine 10 never generates a torque higher than requested. In addition, this relates to a protection for components. In this way, it is ensured that operating limits of components are not exceeded. For example, it is ensured that the temperature of the exhaust-gas pipe 30 is never so high that damage need be feared of the exhaust pipe 30 or of the catalytic converter 46. This relates further to an emergency operation of the engine 10. With this function, it is ensured that the engine 10 can be operated under specific conditions in stratified operation but not in homogeneous operation. Further, this relates to the adjustability of a desired torque of the engine 10 and to the maintenance of desired lambda limits. In addition, it relates to the catalytic converter heating carried out by means of the already described fifth mode of operation with which the catalytic converter 46 can be rapidly heated especially for a cold start of the engine 10. Further, it relates to a control of a storage catalytic converter which, if required, is mounted in the catalytic converter. The storage catalytic converter is provided for the intermediate storage of nitrogen oxides. This function ensures that the storage catalytic converter is again timely discharged after a filling. In addition, this relates to the function of the start or warm running in that the engine 10 may not be operated, for example, in the operating mode of the stratified operation. Further, it relates to the scheduler which administers additional subordinated diagnostic and engine control functions, especially diagnostic and engine control functions which are coupled with respect to each other. Further, it is concerned with an operating mode characteristic field which is provided for the normal driving operation. Here, an operating mode is assigned to each operating point of the engine 10. Further, this relates to a fixed priority list of the operating modes of the engine 10. In addition, a plurality of other functions can be present in the demand list 37.

The lines with the arrows define communication connections 38, 39 between the operating mode coordinator 14 and the operating mode switchover 15. A desired byte 40 and an actual byte 41 schematically define the desired operating mode and the actual operating mode. An operating mode is assigned to each bit of the desired byte 40 and of the actual byte 41. Some bits are held free in order to be able to consider additional operating modes. The hatched surfaces in the desired byte 40 or actual byte 41 mean that these bits are set and define, respectively, the current desired operating mode and the actual operating mode.

The operating mode coordinator 14 shown in FIG. 2 operates in such a manner that the functions of the demand list 37 pose operating mode requests within the operating mode coordinator mode 14 or request desired operating modes. The functions of the demand list 37 request only those operating modes within which they can run. Individual functions of the demand list 37 can also simultaneously request several desired operating modes. The scheduler 13 forms a function of the demand list 37 and assumes the position 8 in the sequence of priorities in the described embodiment after the function start/warm running. Also, the scheduler 13 requests one or several operating modes in the operating mode coordinator 14 equivalent to the other functions of the demand list 37.

The task of the operating mode coordinator 14 comprises to couple the operating mode requests of the individual functions of the demand list 37 in the sequence of their priorities so that an optimal desired operating mode, which corresponds to the operating mode requests, is determined. The desired operating mode is then characterized in the desired byte 40 by the setting of the corresponding bit assigned to the desired operating mode. In this example, the operating mode "homogeneous" was selected as the desired operating mode.

The data as to the determined desired operating mode goes into the operating mode switchover 15 via the communication connection 38. The task of the operating mode switchover 15 comprises switching over the engine 10 into the desired operating mode, which is determined by the operating mode coordinator 14. The operating mode switchover 15 further outputs the actual operating mode of the engine. In the actual byte 41, the operating mode "stratified" is characterized, for example, as the current actual operating mode. The data as to the actual operating mode goes into the operating mode coordinator 14 via the communication connection 39 and is used here especially by the scheduler 13.

Figure 3:
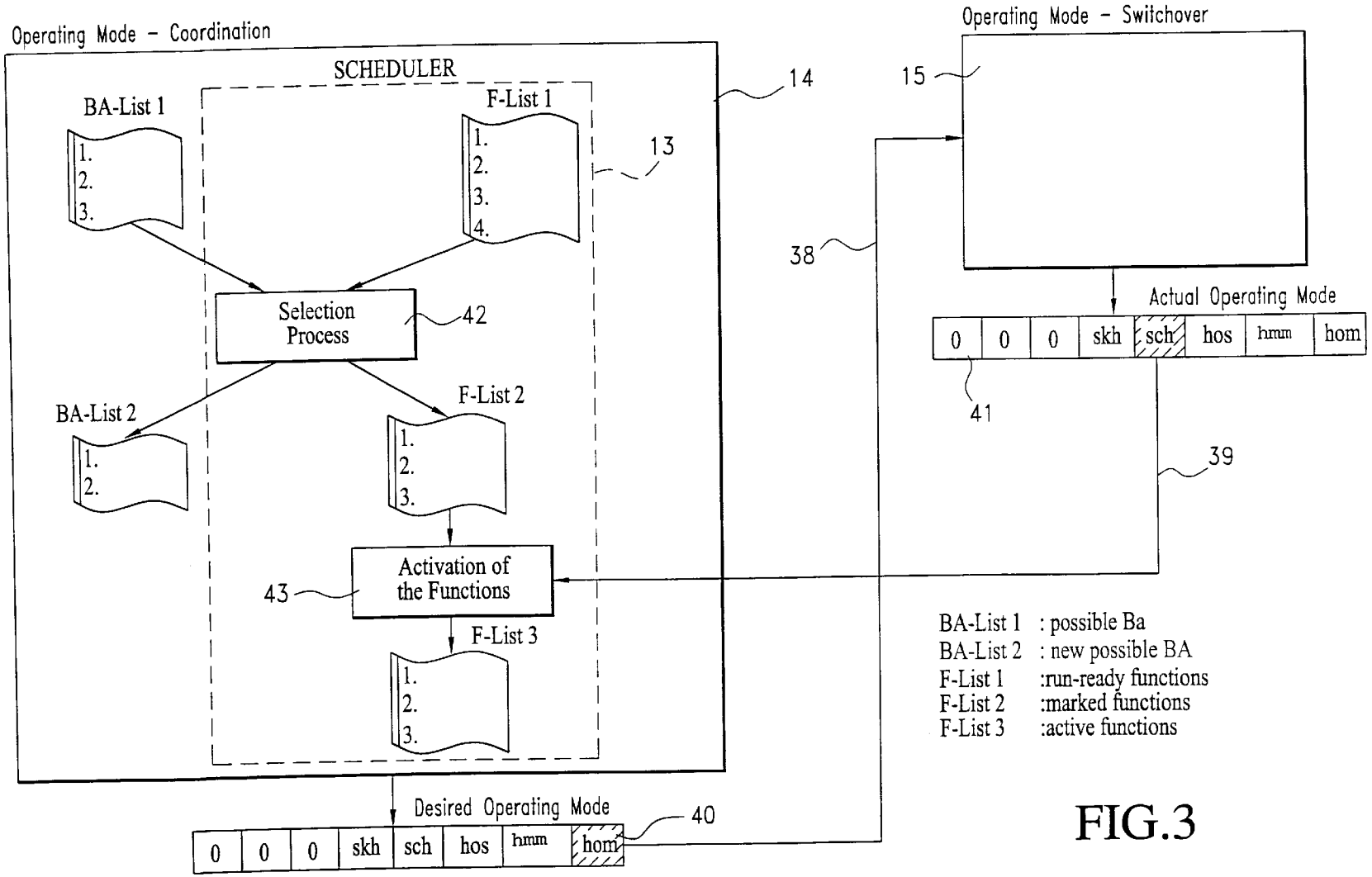
FIG. 3 shows a control apparatus having the functions operating mode coordinator and operating mode switchover with the operation of the scheduler being shown within the operating mode switchover.

FIG. 3 shows a control apparatus 11 having the functions "operating mode coordinator" 14 and "operating mode switchover" 15 as explained already with respect to FIG. 2. Within the operating mode coordinator 14, the scheduler 13 or the function scheduler 13 influences the selection of the desired operating mode.

The scheduler 13, which is shown in FIG. 3, administers or is responsible for the activation of functions 12 which are coupled with respect to each other and can therefore not run simultaneously. In scheduler 13, the following lists are processed or generated:

BA-list 1: List of possible operating modes of the engine 10 or operating modes of the engine which are available for selection. This list is formed from an intermediate result of the operating mode requests of the functions of the demand list 37 of the operating mode coordinator 14.

BA-list 2: New list of possible operating modes wherein the functions 12, which are marked by the scheduler 13, are permitted to run and are given to the operating mode coordinator 14 for further processing.

F-list 1: List of the operationally ready functions 12.

F-list 2: List of the marked functions or functions ready for activation.

F-list 3: List of the active functions 12.

In the scheduler 12, a list "run-ready functions" 12 (F-list 1) is formed from the functions 12 to be administered by the scheduler 12. The F-list 1 can, for example, be formed from functions 12 which are run capable because of the current physical conditions of the engine 10. For example, a function "warm running" shows running readiness only when the temperature of the engine 10 lies below a specific value which corresponds to a cold engine 10. In the operating mode coordinator 14, a list of possible operating modes (BA-list 1) is determined. The BA-list 1 is formed from an intermediate result of the coupling of the operating mode requests of the functions 12 of the demand list 37 in FIG. 2 with a higher prioritizing than the scheduler 13.

The BA-list 1 and the F-list 1 go into a selection method 42 wherein a list of the possible operating modes (BA-list 2) and a list of marked functions 12 or functions made available for activation (F-list 2) is generated. The BA-list 2, which is generated by the selection method 42, goes into the operating mode coordinator 14 for further processing and for determining the desired operating mode. The F-list 2 goes first into a block 43. In block 43, the functions 12 of F-list 2 are activated in dependence upon the current actual operating mode. The functions 12 of the F-list 2 are only then activated when an actual operating mode, which is assigned to these functions 12, is set. The F-list 3 finally contains the active functions 12.

Figure 4:
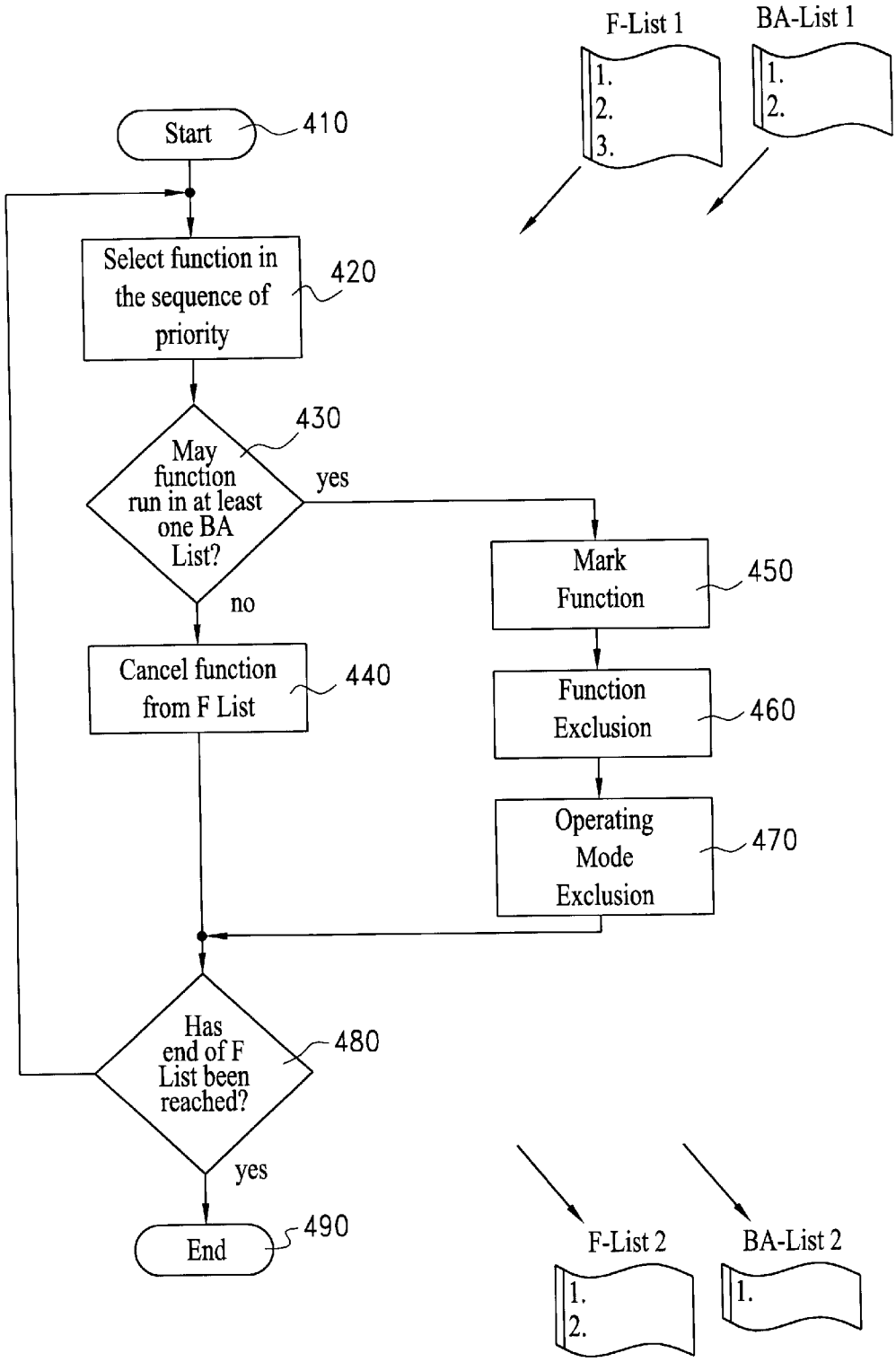
FIG. 4 shows schematically the method sequence of a selection method according to the invention in the scheduler; and, FIG. 5 shows schematically in the form of a table an example for a selection process in the scheduler.

FIG. 4 shows an exemplary selection method 44.

The method shown in FIG. 4 operates in such a manner that, after the start in step 410, the function having the highest priority is selected in step 420 from the list of run-ready functions 12 (F-list 1). In a further step 430, a check is made, while additionally considering the list of possible operating modes (BA-list 1), whether the selected function can start running in one of the operating modes of the BA-list 1, that is, whether at least one of the operating modes of BA-list 2 is assigned to the selected function.

If this is the case, then, in step 450, the selected function is marked. Simultaneously, in a step 460, a function exclusion is executed, that is, all functions 12 from the list F-list 1 are canceled which are not permitted to run simultaneously with the marked function. Furthermore, in step 470, an operating mode exclusion is executed, that is, the BA-list 1 is reduced by those operating modes which are not assigned to the marked function.

When the selected function is not permitted to run in one of the operating modes of the BA-list 1, then this function is canceled from the F-list 1 in step 440.

In step 480, a check is made as to whether the end of the F-list 1 was reached.

If this is the case, then the method is ended in step 490 and, as a result, one obtains a new list of the marked functions 12 (F-list 2) and a new list of the possible operating modes (BA-list 2). The F-list 2 contains the marked functions 12, that is, the functions 12 which are ready for activation. The BA-list 2 contains the operating mode or the operating modes wherein the functions 12 from the F-list 2 are permitted to run. All functions 12 from the F-list 2 may run in each operating mode of the BA-list 2. This means that, when an operating mode is adjusted from the BA-list 2, all functions 12 of the F-list 2 are activated. It can, however, also be possible that an operating mode is set which is not contained in the BA-list 2 and in which not all functions 12 of the F-list 2 are permitted to run. In this case, only the functions 12 of the F-list 2 are activated which can run in the adjusted operating mode.

If the end of F-list 1 was not yet reached, then in step 420, a further function with the next lower priority is selected and the method is carried out as described above. For this purpose, it should be noted that the functions 12, which had been canceled from the F-list 1 in step 440, cannot be selected in step 420.

In an advantageous embodiment of the invention, it is provided that functions 12 define or represent operating modes of the engine 10. That is, a function "homogeneous" represents the operating mode "homogeneous", a function "stratified" represents the function "stratified", et cetera. Logically, just that operating mode is assigned to these functions 12 which they represent. That is, the operating mode "stratified" is assigned to the function "stratified", the operating mode "homogeneous" is assigned to the function "homogeneous", et cetera. These functions 12 are administered just as the remaining "normal" functions 12 by the scheduler 13 and participate in the selection method 42 in the same manner.

A special characteristic of the functions 12, which represent the operating modes, is that they are not exclusive relative to the "normal" functions 12 and that also the "normal" functions 12 are not exclusive compared to the functions 12. That is, the functions 12, which represent the operating modes, do not influence directly the selection of the "normal" functions 12 in the selection method 42, they have essentially only influence on the selection of the operating modes of the BA-list 2.

A further characteristic of these functions 12, which represent the operating modes, is that they go into the F-list 1 as continuously run-ready functions 12. Always at least one operating mode is contained in the BA-list 1 which coincides with the assigned operating mode of one of these functions 12 and these functions 12 are not exclusive relative to the other "normal" functions 12. For this reason, always at least one of these functions 12 is marked. A marked function 12, which represents an operating mode, effects that only the operating mode which is assigned to the marked function is retained in the BA-list 2 during the selection of the operating modes. In this way, it is ensured that only one operating mode in the BA-list 2 is transmitted for further processing to the operating mode coordinator 14.

For the reason that the operating modes are defined with the aid of functions 12, it is furthermore achieved that the selection of the operating modes of the BA-list 2 can be carried out in the same manner as the selection of the functions 12 of the F-list 2. Various criteria such as consumption, tank venting, sequence of diagnostic functions can be considered via the priorities of the functions 12 which represent the operating modes. For example, an operating mode can be selected in this way in dependence upon fuel consumption of the engine 10 into the BA-list 2.

Figure 5:
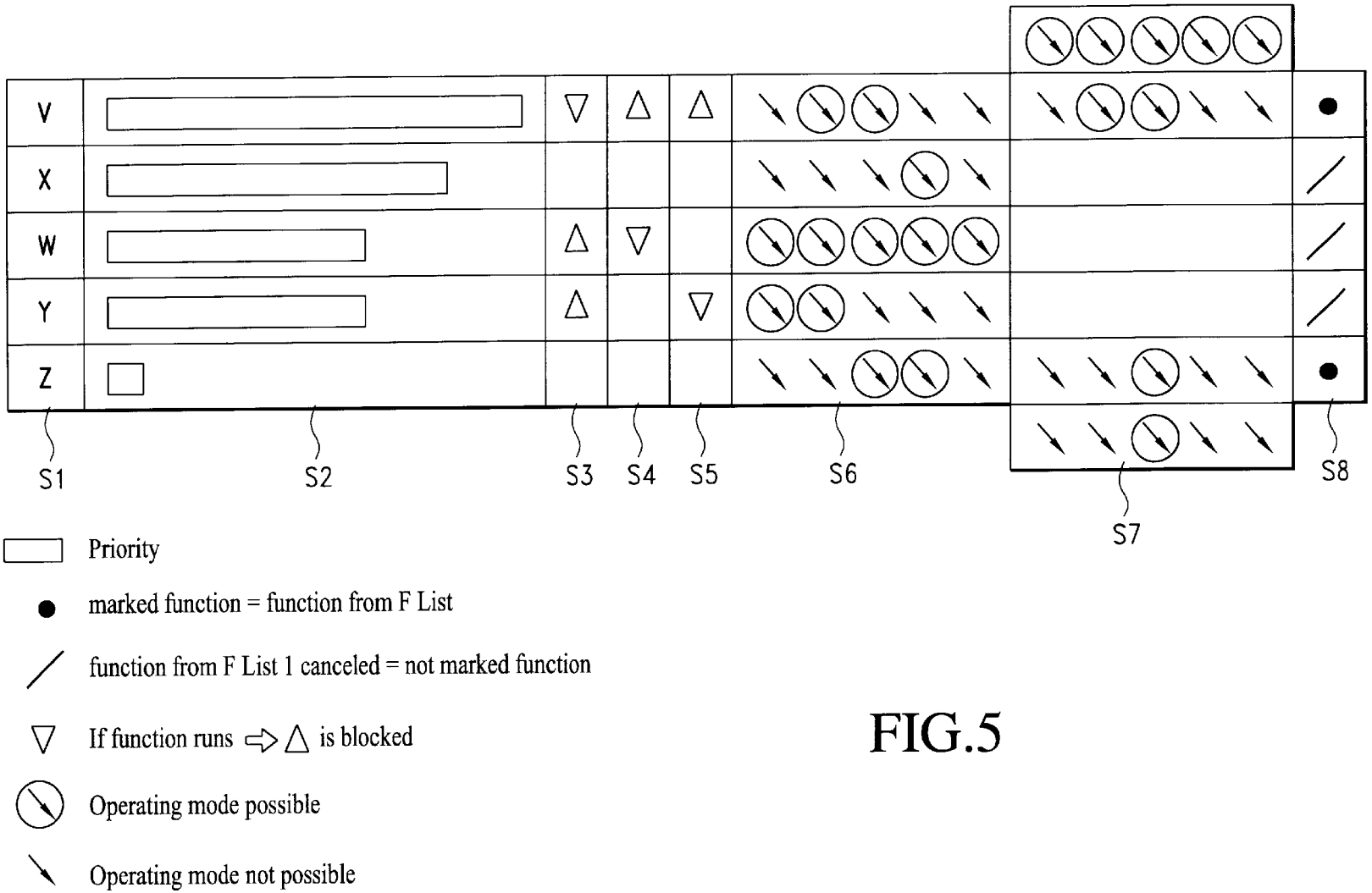

FIG. 5 shows schematically in the form of a table an example for a selection process in the scheduler. Column 1 provides the function identification of the functions 12 from the list of run-ready functions 12 (F-list 1) which is administered by the scheduler. The column 2 provides the priority of these functions 12 in the form of bars. The columns 3, 4 and 5 define a function exclusion table, that is, a table which indicates which functions 12 are not permitted to run simultaneously. In column 6, the operating modes are shown which are assigned to the functions 12. The column 7 defines the selection of the BA-list 2 or an operating mode exclusion. The upper cell of column 7 indicates the operating modes, which are possible from an intermediate result of the operating mode coordinator 14 in FIG. 2. It corresponds to the list of possible operating modes (BA-list 1). The lower cell of column 7 indicates the operating modes (BA-list 2) requested by the scheduler 13 from the operating mode coordinator 14 in FIG. 2. The functions 12, which are characterized in the column 8 with a point, are the marked functions 12, that is, the functions 12 made available for activation. These functions 12 define the list of the run-ready functions 12 (F-list 2). The functions 12, which are characterized by a line, correspond to the functions 12 canceled in step 440 (see FIG. 4) from the list of run-ready functions 12 (F-list 1).

As can be seen in FIG. 5, the functions 12 V, X, W, Y, Z in column 2 are shown in the sequence of their priority. Long bars mean a high priority and short bars a low priority. A high priority of the functions 12 signalizes a high extent as to run-readiness or the desire to be permitted to run as soon as possible.

The columns 3, 4, 5 define the exclusion conditions or the functions exclusions. A column of functions exclusions is to be read as follows: when a function has been marked, which is marked with a triangle having the apex directed downwardly, then the functions 12 in the same column may not be marked which are characterized with a triangle having the apex directed upwardly. For example, the column 3 in FIG. 5 means that the functions 12 W and Y may not be marked when the function V has been marked. The column 4 means that the function V may not be marked when function W has just been marked and the column 5 means that function V may not be marked when function Y has just been marked. The columns 4 and 5 result from column 3. As shown in column 3, function W may not be marked when function V has already been marked. For this reason, the reverse conclusion generally applies, that is, that function V may not be marked when function W has just been marked.

In column 6 (column of operating modes assigned to functions 12), circled arrows mean that the function corresponding thereto may run when the operating mode, which corresponds to the circled arrow, is set and normal arrows mean that the function may not be run in the operating mode corresponding to the normal arrow. One can discern from this column that some functions 12 may run in more than one operating mode, that is, several arrows are shown circled.

In column 7, the sequence of the operating mode exclusion is shown, that is, it is shown how the list of possible modes of operation (BA-list 1) is reduced by the modes of operation wherein the marked functions 12 are not permitted to run. The reduction of the BA-list 1 and the F-list 1 cannot be viewed separately. The reduction of the BA-list 1 and the F-list 1 takes place simultaneously in steps 460 and 470 as set forth in the description of FIG. 4. The list of possible modes of operation is reduced from top to bottom. The circled arrows indicate the modes of operation which are still possible.

In this embodiment, one can recognize in the upper cell of column 7 that all modes of operation are at first possible, that is, all arrows are first circled. In column 8, one can recognize that the function V has been marked. From this, it results that precisely those operating modes from the first cell are canceled in which the marked function V may not run as set forth in column 6. This result can be read in the second cell of column 7. One recognizes that only those operating modes remain wherein the function V may run. The functions 12 X, W and Y have not been marked and therefore these also no longer influence the selection of the modes of operation. The function Z was marked. This means that the operating modes from second cell of column 7 are canceled wherein the function Z may not run as set forth in column 6. In the last cell of column 7, the result of the selection of the operating modes (BA-list 2) still possible is shown.

The function V was the first marked because this function has the highest priority, that is, it has the longest bar and because the assigned operating modes coincide with two of the possible modes of operation of cell 1, column 7, as set forth on column 6. The function X was not marked because the assigned operating mode (see column 6) does not correspond with any of the still possible modes of operation as set forth in the second cell of column 7. The functions W and Y were not marked because these functions are not permitted to run simultaneously with the already marked function V as is evident from the function exclusion table, columns 3, 4 and 5.

The operating mode, which remains in the lowest cell of column 7, corresponds to the operating mode which the scheduler 13 requests at the operating mode coordinator 14.

Also, more than one mode of operation can be requested at the operating mode coordinator 14.

What is claimed is:

1. A method for operating an internal combustion engine, including an engine having direct injection (DE) or intake manifold injection (SRE) with a control apparatus, the engine having instantaneous adjustable modes of operation and the control apparatus or its software having a plurality of functions and a scheduler for activating the functions, the method comprising the steps of:

operating said engine in at least two modes of operation;

assigning at least one operating mode to each of said functions; and, marking run-ready functions or making said run-ready functions ready for activation utilizing said scheduler in dependence upon the mode of operation assigned thereto and the instantaneously adjustable modes of operation of the engine.

2. The method of claim 1, wherein said run-ready functions are made ready for activation.

3. The method of claim 1, wherein said modes of operation are requested at an operating mode coordinator by the scheduler wherein the marked functions are permitted to run.

4. The method of claim 1, wherein: an operating mode is assigned to the marked functions; and, said engine is switched over into the operating mode assigned to the marked functions utilizing an operating mode switchover.

5. The method of claim 1, wherein the marked functions are only then activated by the scheduler when the operating mode, which is assigned to the marked functions, is set.

6. The method of claim 1, wherein at least one operating mode is assigned to said functions in dependence upon operating conditions of the engine wherein the functions can run or precisely those operating modes are assigned wherein the function cannot run.

7. The method of claim 1, wherein the modes of operation are fixedly assigned to the functions.

8. The method of claim 1, wherein the scheduler marks precisely the functions or makes those functions available for activation which can run simultaneously and which have at least one common assigned operating mode.

9. The method of claim 1, wherein the scheduler marks the functions or makes the functions ready for activation in a sequence of their priorities.

10. The method of claim 1, wherein the scheduler can activate a single function or can simultaneously activate several marked functions.

11. The method of claim 1, wherein the functions define diagnostic functions and/or engine control functions and/or operating modes of the engine.

12. The method of claim 1, wherein the method is applied in a transmission, a brake system or any desired electromechanical system.

13. A control apparatus for operating an internal combustion engine of a motor vehicle, including an internal combustion engine having direct injection (DE) or intake manifold injection (SRE), the engine having instantaneous adjustable modes of operation, the control apparatus comprising:

a plurality of functions and a scheduler for activating the functions;

means for operating the motor vehicle or the engine in at least two operating modes;

said scheduler functioning to assign to each function at least one mode of operation; and, means for marking run-ready functions or making said run-ready functions ready for activation utilizing said scheduler in dependence upon their assigned operating mode and the instantaneously adjustable modes of operation of the engine.

14. The control apparatus of claim 13, wherein said control apparatus has software which contains said plurality of functions and said scheduler for activating the functions.

* * * * *